US007886714B2

(12) United States Patent
Kashima

(10) Patent No.: US 7,886,714 B2
(45) Date of Patent: Feb. 15, 2011

(54) EXHAUST GAS REFLUX MECHANISM FOR MULTIPURPOSE ENGINE

(75) Inventor: Soji Kashima, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/488,766

(22) Filed: Jun. 22, 2009

(65) Prior Publication Data

US 2009/0320792 A1 Dec. 31, 2009

(30) Foreign Application Priority Data

Jun. 26, 2008 (JP) ..... 2008-167866

(51) Int. Cl.
*F02D 13/00* (2006.01)
*F01L 1/34* (2006.01)

(52) U.S. Cl. ..... 123/347; 123/90.17

(58) Field of Classification Search ..... 123/321–322, 123/347–348, 568.14, 90.15–90.17, 90.22–90.23, 123/90.39–90.41
See application file for complete search history.

(56) References Cited

U.S. PATENT DOCUMENTS 1,952,881 A 3/1934 Minter
6,085,705 A * 7/2000 Vorih ..... 123/90.12
6,125,828 A * 10/2000 Hu ..... 123/568.14
6,349,688 B1 2/2002 Gracyalny et al.
6,354,254 B1 * 3/2002 Usko ..... 123/90.16
6,439,195 B1 * 8/2002 Warner ..... 123/321
6,478,015 B2 * 11/2002 Oki et al. ..... 123/520
6,883,492 B2 * 4/2005 Vanderpoel et al. ..... 123/321
6,892,714 B2 5/2005 Kashima et al.
7,152,576 B2 * 12/2006 Vanderpoel et al. ..... 123/321
7,500,466 B2 * 3/2009 Noss et al. ..... 123/321
7,712,449 B1 * 5/2010 Schwoerer ..... 123/321
2003/0200954 A1 10/2003 Zsoldos et al.
2005/0145216 A1 * 7/2005 Yang et al. ..... 123/321

FOREIGN PATENT DOCUMENTS

JP 2004-169687 A 6/2004

OTHER PUBLICATIONS

European Search Report dated Oct. 23, 2009, issued in corresponding European Patent Application No. 09251643.4.

* cited by examiner

*Primary Examiner*—Stephen K Cronin
*Assistant Examiner*—Johnny H Hoang
(74) *Attorney, Agent, or Firm*—Westerman, Hattori, Daniels & Adrian, LLP

(57) ABSTRACT

An exhaust gas reflux mechanism for a multipurpose engine includes an exhaust reflux cam formed as an integral part of an single cam of the engine and having a cam lobe profiled to open an exhaust valve while an intake valve stays open during the intake stroke of the engine so that part of an exhaust gas remaining on the side of an exhaust port of the engine is drawn into a combustion chamber during the intake stroke.

5 Claims, 5 Drawing Sheets

EXHAUST GAS REFLUX MECHANISM FOR MULTIPURPOSE ENGINE

FIELD OF THE INVENTION

The present invention relates to an improvement in an exhaust gas reflux mechanism for a multipurpose engine.

BACKGROUND OF THE INVENTION

An example of conventional exhaust gas reflux apparatus is disclosed in Japanese Patent Laid-open Publication (JP-A) No. 2004-169687 (corresponding to U.S. Pat. No. 6,892,714). The disclosed exhaust gas reflux apparatus is configured such that a reflux of exhaust gas into a combustion chamber is controlled according to the opening degree of a throttle valve.

More particularly, the exhaust gas reflux apparatus shown in JP 2004-169687A includes a pair of supports disposed on a cylinder head, an auxiliary rocker shaft supported by the supports, an auxiliary rocker arm placed between the supports and pivotably and axially slidably supported by the auxiliary rocker shaft, an interlock pin protruding from an intake rocker arm and axially slidably fitted in a slot formed in one end of the auxiliary rocker arm, a gap adjustment bolt threaded onto the other end of the auxiliary rocker arm, a connection piece formed on an exhaust rocker arm correspondingly to the gap adjustment bolt, and a negative pressure actuator operable to move the auxiliary rocker arm along the auxiliary rocker shaft via a shaft fork.

When the opening degree of the throttle valve reaches a predetermined value during operation of the engine, a negative pressure acting on the negative pressure actuator exceeds a predetermined value whereupon the actuator operates to pull the shift fork to move the auxiliary rocker arm toward the exhaust rocker arm so that the gap adjustment bolt rides on the connection piece of the exhaust rocker arm. When an intake rocker arm rocks to open an intake valve during the intake stroke, the interlock pin causes the auxiliary rocker to rock in an interlocked manner to press down the connection piece via the gap adjustment bolt. As a result, the exhaust rocker arm rocks to slightly open the exhaust valve. In this way, when the exhaust valve is opened during the intake stroke, the exhaust gas remaining on the side of an exhaust port is sucked or drawn into a combustion chamber, that is, a reflux of exhaust gas occurs during the intake stroke of the engine.

In the disclosed exhaust gas reflux apparatus, the negative pressure actuator for achieving the exhaust gas reflux is operative only when the throttle valve has a predetermined middle opening degree. Furthermore, due to the use of the auxiliary rocker arm, the shift fork and the actuator, the conventional exhaust gas reflux apparatus is relatively large in size and complicated in construction, which will increase the overall size and weight of the engine.

In small-sized multipurpose engines for use in lawnmowers, for example, there is provided a governor for automatically regulating the opening degree of a throttle valve according to load variations from a start-up of the engine so that the engine speed reaches a predetermined operating speed. By virtue of the governor thus provided, the operability of the engine is considerably improved. However, in order to reduce the load on a human operator, a further reduction in size and weight of the small-sized multipurpose engines is highly desirable. As for an exhaust gas reflux mechanism to be incorporated in such small-sized multipurpose engines, consideration must be given not to increase the size and weight of the engine.

It is therefore an object of the present invention to provide an exhaust gas reflux mechanism for a multipurpose engine, which is simple in construction and small in size and weight and, hence, is able to achieve downsizing and cost-reduction of the multipurpose engine.

SUMMARY OF THE INVENTION

According to the present invention, there is provided an exhaust gas reflux mechanism for a multipurpose engine having an engine speed designed to automatically increase to a predetermined operating speed after a start-up of the engine and including an intake valve, an exhaust valve, and a single cam provided on a camshaft and driven to open and close the intake and exhaust valves in timed relation to each other. The exhaust gas reflux mechanism comprises an exhaust reflux cam formed integrally with the single cam as an integral part of the since cam and having a cam lobe profiled to open the exhaust valve while the intake valve stays open during an intake stoke of the engine, so that a reflux of exhaust gas into a combustion chamber of the engine occurs during the intake stroke.

After a start-up of the multipurpose engine, the engine speed automatically increases up to a predetermined operating speed (i.e., a rated speed). While the intake valve stays open during the intake stroke of the engine, the exhaust valve is opened by the action of the cam lobe of the exhaust reflux cam. As a result, part of an exhaust gas remaining on the side of an exhaust port of the engine is sucked or drawn into a combustion chamber of the engine during the intake stroke. Thus, from the start-up of the engine, a reflux of exhaust gas occurs during the intake stroke of the engine. During combustion of an air-fuel mixture during an expansion stroke in a later stage, the refluxed exhaust gas inhibits an excessive increase in combustion temperature of the air-fuel mixture, to reduce NOx concentration in the exhaust gas.

Since the exhaust gas reflux mechanism is comprised of an exhaust reflux cam which is formed integrally with the single cam of the multipurpose engine as an integral part of the single cam, the exhaust gas reflux mechanism is simple in construction and small in size and weight, which will lead to downsizing and cost-reduction of the multipurpose engine.

In one preferred form of the present invention, while the intake valve stays open during the intake stroke, the exhaust reflux cam opens the exhaust valve after the exhaust valve finishes closing by the action of the single cam.

In another preferred form of the present invention, while the intake valve stays open during the intake stroke, the exhaust reflux cam lifts up the exhaust valve again before the exhaust valve finishes closing by the action of the single cam.

Preferably, the cam lobe of the exhaust reflux cam is profiled to finish closing of the exhaust valve at the end of the intake stroke. This arrangement is advantageous for highly efficient reduction of NOx concentration in the exhaust gas.

A valve lift provided by the exhaust reflux cam to the exhaust valve is smaller than a valve lift provided by the single cam to the exhaust valve. Preferably, the valve lift provided by the exhaust reflux cam to the exhaust valve is approximately one-seventh of the valve lift provided by the single cam to the exhaust valve.

BRIEF DESCRIPTION OF THE DRAWINGS

Certain preferred embodiments of the present invention will be described in detail below, by way of examples only, with reference to the accompanying drawings, in which.

DETAILED DESCRIPTION OF THE PREFERRED EMBODIMENTS

Figure 1:
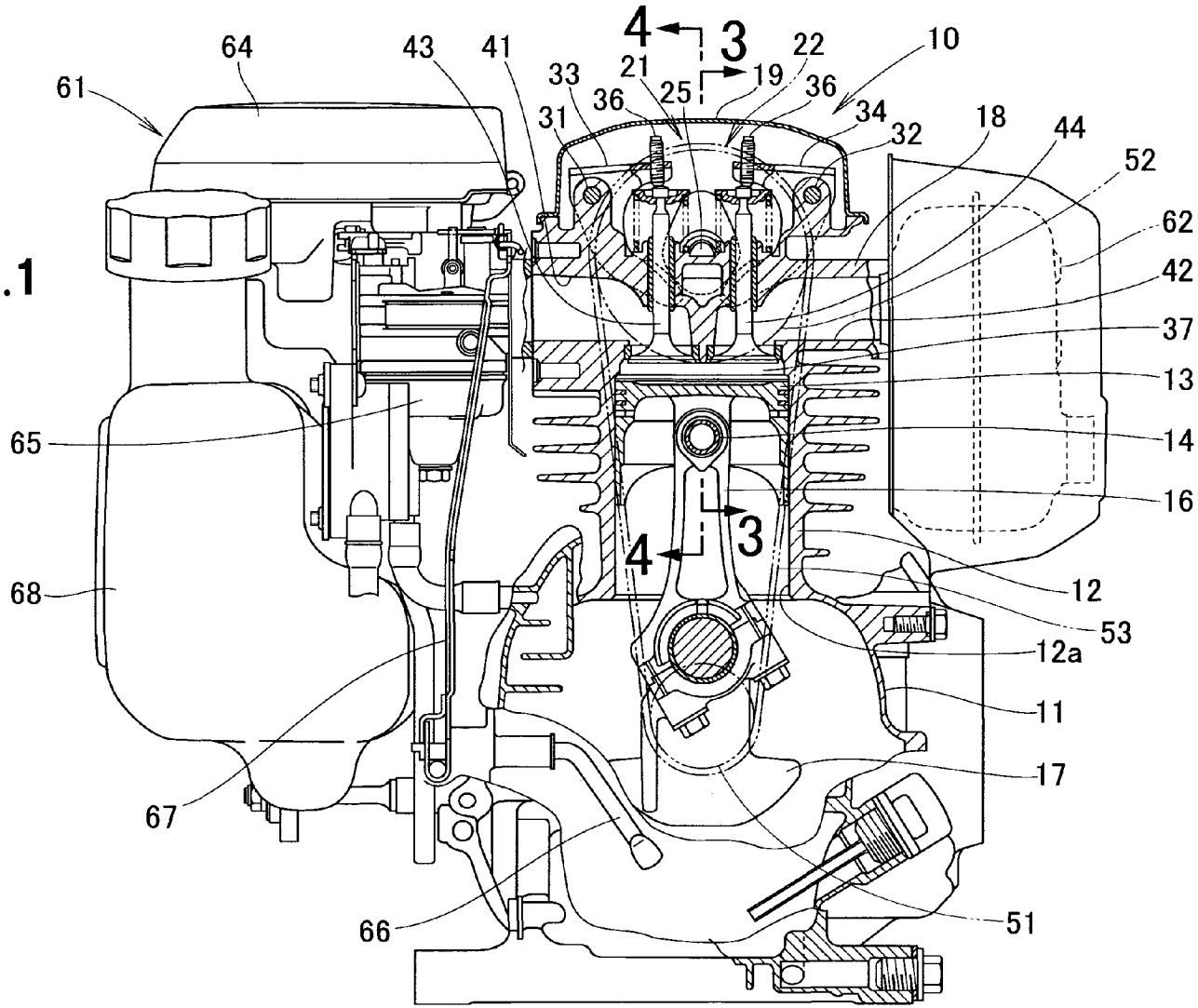
FIG. 1 is a front elevational view, with parts in cross section for clarity, of at multipurpose engine in which an exhaust gas reflux mechanism according to a first embodiment of the present invention is incorporated.

Referring now to the drawings and FIG. 1 in particular, there is shown a multipurpose engine 10 in which an exhaust gas reflux mechanism embodying the present invention is incorporated. The engine to includes a crankcase 11, a cylinder block 12 mounted to an upper end of the crankcase 11, a piston 13 slidably received in a cylinder bore 12*a* formed in the cylinder block 12, a connecting rod 16 pivotally connected at one end to the piston 13 by a piston pin 14, a crankshaft 17 connected to the other end of the connecting rod 16 and rotatably supported by mating surfaces of the crankcase 11 and the cylinder block 12, a cylinder head 18 formed integrally with an upper part of the cylinder block 12, a head cover 19 that closes an upper opening of the cylinder head 18, a valve operating mechanism 21 provided on the cylinder head 18, a timing drive mechanism 22 for driving the valve operating mechanism 21 in timed relation to rotation of the crankshaft 17, and a governor (not shown) for automatically regulating the opening degree of a throttle valve 83 (FIG. 5) according to load variations to thereby control the rotational speed of the engine 10 so that the engine rotational speed automatically goes up to a predetermined operating speed (i.e., a rated speed) after a start-up of the engine 10. The engine rotational speed will be hereinafter referred to, for brevity, as "engine speed".

The valve operating mechanism 21 includes a camshaft 25 rotatably mounted on a central portion of the cylinder head 18, an intake rocker shaft 31 and an exhaust rocker shaft 32 each mounted on an upper part of the cylinder head 18, an intake rocker arm 33 and an exhaust rocker arm 34 pivotally mounted on the intake rocker shaft 31 and the exhaust rocker shaft 32, respectively, and driven in timed relation to each other by a single cam 75 (FIGS. 2A and 2B) provided on the camshaft 25, and an intake valve 43 and an exhaust valve 44 each having an upper stem end held in contact with one end (driving end) of a corresponding one of the intake and exhaust rocker arm 33 and 34 via an adjusting screw 36. The intake valve 43 and the exhaust valve 44 are operated to open and close open ends of an intake port 41 and an exhaust port 42, respectively, that face a combustion chamber 37 of the engine 10.

The timing drive mechanism 22 includes a driving pulley 51 mounted on the crankshaft 17 for rotation therewith, a driven pulley 52 mounted on the camshaft 25 for rotation therewith, a toothed bent 53 extending between the driving pulley 51 and the driven pulley 52, and a belt tensioner (not shown) for applying a proper tension to the toothed belt 53.

The engine 10 further includes an intake system 61 mounted to the cylinder head 18, and a silencer 62 communicating with the exhaust port 42 as an exhaust system. The intake system 61 includes an air-cleaner 64, and a carburetor 65 connected with the air-cleaner 64 and communicating with the intake port 41 of the cylinder head 18.

The carburetor 65 is equipped with a choke valve 82 (FIG. 5) for improving the start-up performance of the engine 10, a choke lever 66 provided on a front portion of the engine 10 for manually opening and closing the choke valve 82, and a link 67 operatively interconnecting the choke valve 82 and the choke lever 66. Reference numeral 68 shown in FIG. 1 denotes a fuel tank from which a fuel is supplied to the carburetor 65.

The governor has a structure known per se and a further description can be omitted. One example of such known governors is disclosed in Japanese Patent Laid-open Publication (JP-A) No. 8-177441.

The exhaust gas reflux mechanism embodying the invention will be described with reference to FIGS. 2A and 2B. The exhaust gas reflux mechanism comprises an exhaust reflux cam 76 which is formed integrally with the single cam 75 of the valve operating mechanism 21 as an integral part of the single cam 75 and has a cam projection or lobe 76*a* profiled to open the exhaust valve 44 (FIG. 1) via the exhaust rocker arm 34 while the intake valve 43 (FIG. 1) stays open during an intake stroke (suction stroke) of the engine 10, as will be explained later.

Figure 2A:
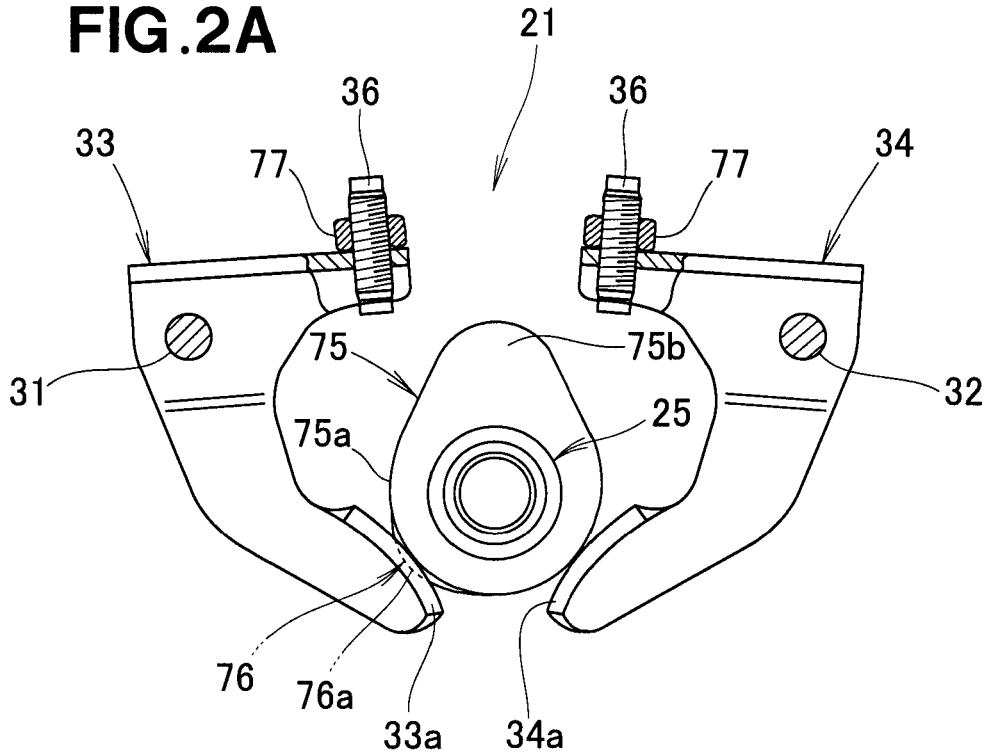
FIGS. 2A and 2B are diagrammatical views illustrative of the operation of the exhaust gas reflux mechanism.

As shown in FIG. 2A, lower ends 33*a*, 34*a* of the intake and exhaust rocker arms 33, 34 are in contact with a cam face of the single cam 75 and hence these rocker arm ends 33*a*, 34*a* form cam followers. The cam 75 has a base circle (also called "heel") 75*a* and a cam projection or lobe 75*b* that form the cam face of the cam 75. When the cam 75 turns through one motion cycle, the cam followers 33*a*, 34*a* execute a series of events consisting of rises, dwells and returns. Rise is the motion of each cam follower 33*a*, 34*a* away from the cam center (coincident with the axis of the camshaft 25), dwell is the motion during which the each cam follower 33*a*, 34*a* is at rest, and return is the motion of the each cam follower toward the cam center. In the condition shown in FIG. 2A, the cam followers 33*a*, 33*b* (i.e., the lower ends of the intake and exhaust rocker arms 33, 34) contact with the base circle 75*a* of the single cam 75 so that the cam followers 33*a*, 33*b* are in a dwelling event during which they are at rest, and both of the intake valve 43 (FIG. 1) and the exhaust valve 4 (FIG. 1) are in a closed state. Reference numeral 77 shown in FIGS. 2A and 2B denotes a lock nut for locking the associated adjusting screw 36 in position against movement relative to the associated rocker arm 33 or 34.

The lower end 33*a* of the intake rocker arm 33 and the cam lobe 76*a* of the exhaust reflux cam 76 are displaced from each other in an axial direction of the camshaft 25, and the lower end 33*a* of the intake rocker arm 33 and the lower end 34*a* of the exhaust rocker arm 34 are displaced from each other in the axial direction of the camshaft 25, so that the lower end 33*a* of the intake rocker arm 33 is brought into driven engagement with only the cam lobe 75*b* of the cam 75 whereas the lower end 34*a* of the exhaust rocker arm 34 is brought into driven engagement with both of the cam lobe 75*b* of the cam 75 and the cam lobe 76*a* of the exhaust reflux cam 76, as will be described later.

Figure 2B:
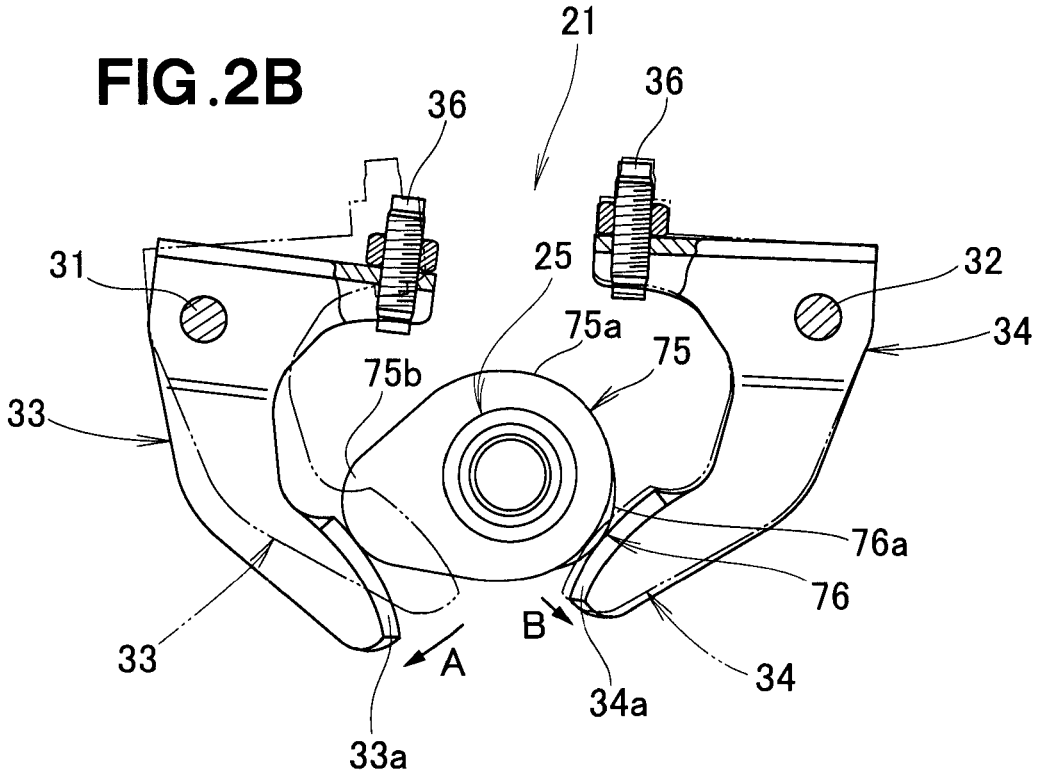

In a condition shown in FIG. 2B, the lower end 33*a* of the intake rocker arm 33 contacts with the cam lobe 75*b* of the cam 75. This causes the intake rocker 33 to rock or turn clockwise about the intake rocker shaft 31 from the rest position of FIG. 2A, as indicated by the arrow A. With this rocking movement of the intake rocker arm 33, the adjusting screw 36 on the upper end of the intake rocker arm 33 forces the upper stem end of the intake valve 43 (FIG. 1) in a downward direction to thereby open the intake valve 43. Thus, a fresh air-fuel mixture is drawn into the combustion chamber 37 in an intake stroke of the engine 10. At the same time, the lower end 34*a* of the exhaust rocker arm 34 contacts with the cam lobe 76*a* of the exhaust reflux cam 76. This causes the exhaust rocker 34 to rock or turn counterclockwise about the exhaust rocker shaft 32 from the rest position of FIG. 2A, as indicated by the arrow B. With this rocking movement of the exhaust rocker arm 34, the adjusting screw 36 on the upper end of the exhaust rocker arm 34 forces the upper stem end of the exhaust valve 44 (FIG. 1) in a downward direction to thereby open the exhaust valve 44. In this instance, since a valve lift which is provided by the cam lobe 76*a* of the exhaust reflux cam 76 to the exhaust valve 44 via the exhaust rocker arm 34 is much smaller than a valve lift which is provided by the cam lobe 75*b* of the cam 75 via the intake rocker arm 33, the exhaust valve 44 is slightly open while the intake valve 43 is open during the intake stroke. As a result, part of an exhaust gas remaining on the side of the exhaust port 42 is sucked or drawn into the combustion chamber 37. Thus, a reflux of exhaust gas occurs in the intake stroke of the engine 10. Since the cam lobe 75*b* of the cam 75 is also engageable with the lower end 34*a* of the exhaust rocker arm 34 for opening and closing the exhaust valve 44, the lift of the exhaust valve 44 caused by the action of the exhaust reflux cam lobe 76 is also much smaller than a lift of the exhaust valve 44 caused by the action of the cam lobe 75*b* of the cam 75.

Figure 3:
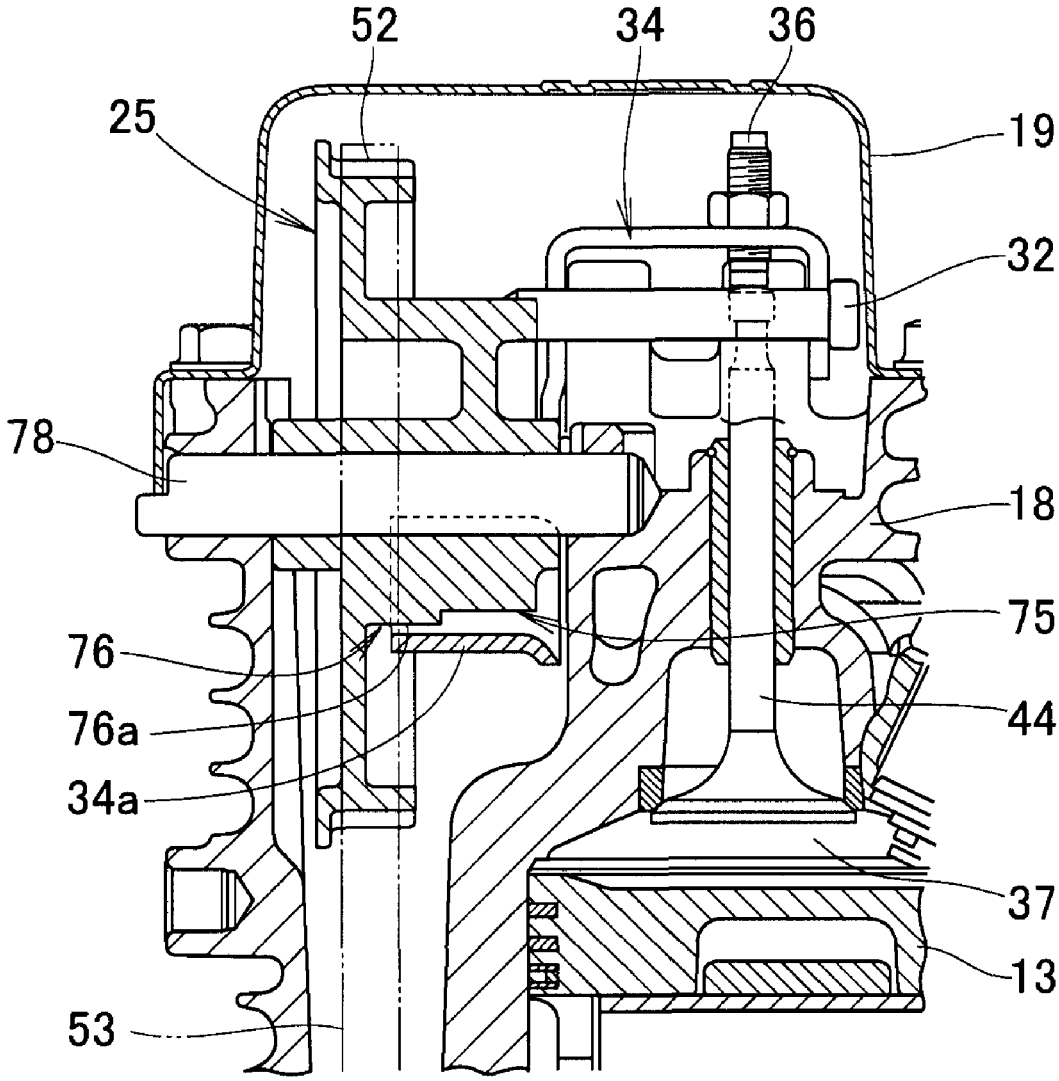
FIG. 3 is a cross-sectional view taken along line 3-3 of FIG. 1.

FIG. 3 is a cross-sectional view taken along line 3-3 of FIG. 1, showing the positional relationship between the cam lobe 76*a* of the exhaust reflux cam 76 and the exhaust rocker arm 34. As shown in this figure, the camshaft 25 including the cam 75 is rotatably supported on a support shaft 78 mounted on the cylinder head 18, and the lower end 34*a* of the exhaust rocker arm 34 overlaps both of the cam face of the exhaust reflux cam lobe 76*a* and the cam face (including the base circle 75*a* and the cam lobe 75*b*) of the cam 75 in the axial direction of the camshaft 25. With this overlapping arrangement, the lower end 43*a* of the exhaust rocker arm 43 is brought into driven engagement with both of the cam lobe 76*a* of the exhaust reflux cam 76 and the cam lobe 75*b* of the cam 75 when the cam 75 turns through one motion cycle.

Figure 4:
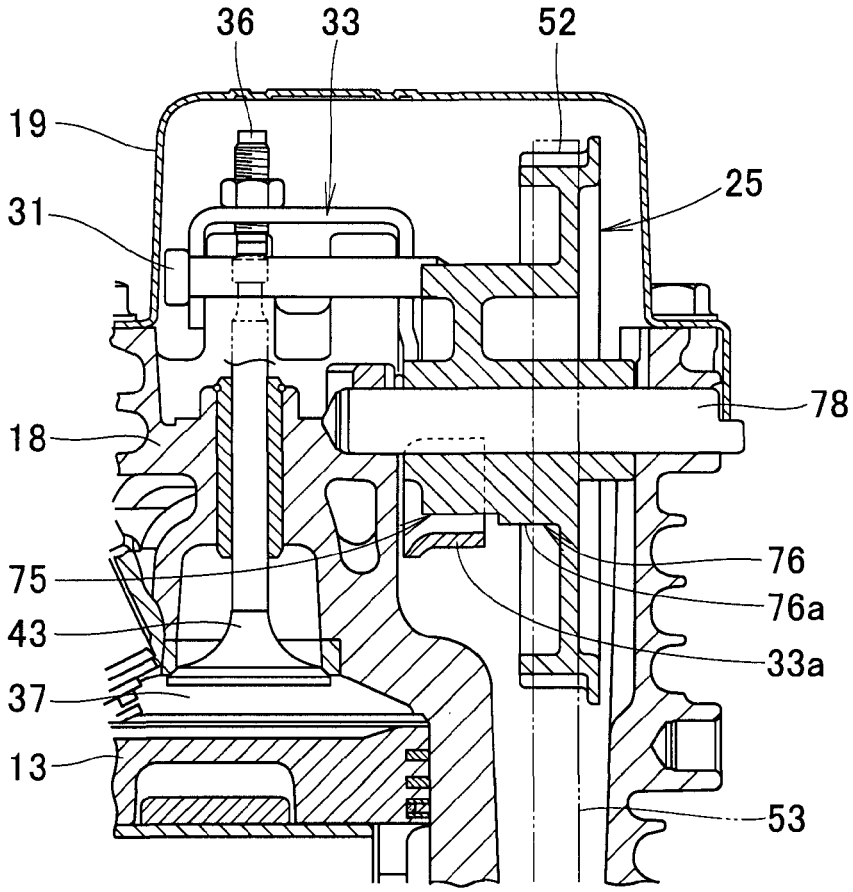
FIG. 4 is a cross-sectional view taken along line 4-4 of FIG. 1.

FIG. 4 is a cross-sectional view taken along line 3-3 of FIG. 1, showing the positional relationship between the cam lobe 76*a* of the exhaust reflux cam 76 and the intake rocker arm 33. As shown in this figure, looking in the axial direction of the camshaft 25, the lower end 33*a* of the intake rocker arm 33 does not overlap the cam face of the exhaust reflux cam lobe 76*a* but does overlap the cam face (including the base circle 75*a* and the cam lobe 75*b*) of the cam 75. With this arrangement, the lower end 33*a* of the intake rocker arm 33 is brought into driven engagement with only the cam lobe 75*b* of the cam 75 when the cam 75 turns through one motion cycle. The cam lobe 76*a* of the exhaust reflux cam 76 is kept out of engagement with the lower end 33*a* of the intake rocker arm 33 during the motion cycles of the cam 75.

Figure 5:
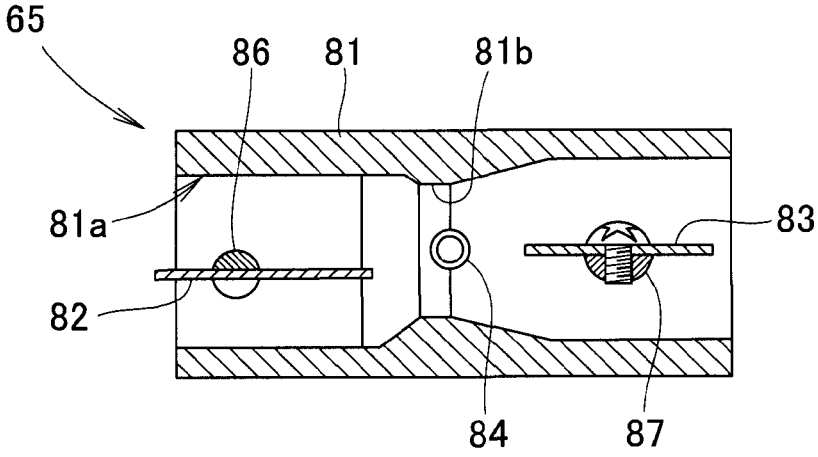
FIG. 5 is a cross-sectional view of a carburetor of the multipurpose engine.

FIG. 5 shows in cross section a main portion of the carburetor 65 of the multipurpose engine 10 (FIG. 1). As shown in this figure, the carburetor 65 includes a tubular body 81 having a main air passage 81*a* formed therein and having a constricted passage part forming a venturi portion 81*b*, the choke valve 82 disposed in the main air passage 81*a* upstream of the venturi portion 81*b*, and the throttle valve 83 disposed in the main air passage 81 downstream of the venturi portion 81*b*. The opening degree of the choke valve 82 can be adjusted by manual operation of the choke lever 66. The opening degree of the throttle valve 83 is automatically controlled by the governor (not shown).

The multipurpose engine 10 (FIG. 1) does not have any operation member such as a throttle lever that can be operated by a human operator to manually regulate the opening degree of the throttle valve 83. The human operator is not possible to regulate the opening degree of the throttle valve 83.

Reference character 84 shown in FIG. 5 denotes a main nozzle 84 for ejecting the fuel into the main air passage 81*a* of the carburetor body 81; 84 a choke value shaft rotatably mounted on the carburetor body 81 for supporting the choke valve 82 within the main air passage 81*a*; and 87 a throttle valve shaft rotatably mounted on the carburetor body 81 for supporting the throttle valve 83 within the main air passage 81*a*.

Figure 6:
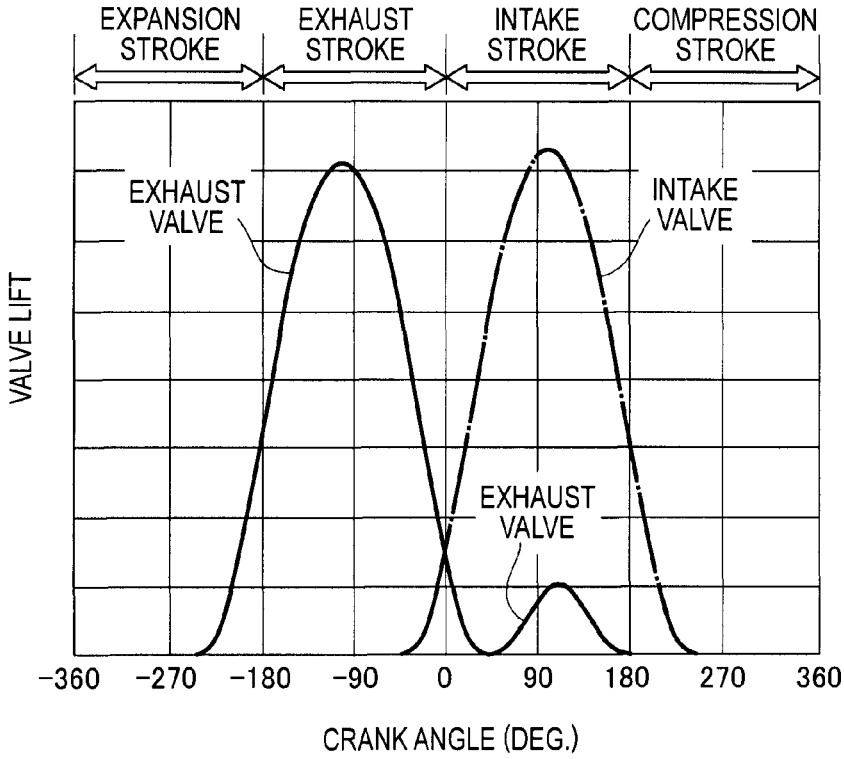
FIG. 6 is a graph showing the valve opening and closing timing of an intake valve and an exhaust valve of the multipurpose engine according to the first embodiment of the present invention.

FIG. 6 is a graphical representation of the valve opening and closing timing of the intake and exhaust valves 43 and 44 according to the first embodiment of the present invention. In the graph shown in FIG. 6, the vertical axis represents the valve lift and the horizontal axis represents the crank angle. The valve lift of the intake valve 43 is indicated by a chain line shown in FIG. 6, while the valve lift of the exhaust valve 44 is indicated by a solid line shown in FIG. 6.

As shown in FIG. 6, the exhaust valve 44 begins to open a little before the end of the expansion stroke (also called "power stroke") of the engine, stays open throughout the exhaust stroke, and finishes closing a little after the start of the intake stroke. The intake valve 43 begins to open a little before the end of the exhaust stroke, stays open throughout the intake stroke, and finishes closing a little after the start of the compression stroke. The intake valve 43 is made to open before the exhaust valve 44 closes. The period between the intake valve opening and the exhaust valve closing is called "valve overlap". While the intake valve 43 stays open during the intake stroke, the exhaust valve 44 finishes closing by the action of the cam 75 and subsequently undergoes opening and closing motion again by the action of the cam lobe 76*a* of the exhaust reflux cam 76 (FIG. 2B). More specifically, by the action of the exhaust reflux cam lobe 76*a*, the exhaust valve 44 begins to open after the exhaust valve finishes closing by the action of the cam 75, stays open for a predetermined period of time, and finishes closing at the end of the intake stroke. In this instance, the lifts of the exhaust valve 44 and the intake valve 43 have peak values (maximum values) substantially at the same time. Furthermore, the lift of the exhaust valve 44 caused by the exhaust reflux cam lobe 76 is much smaller than (approximately one-seventh of) the lift of the exhaust valve 44 caused by the cam lobe 75*b* of the cam 75.

As a result, when the exhaust valve 44 is opened during the intake stroke, the exhaust gas remaining on the side of the exhaust port 42 (FIG. 1) is sucked or drawn into the combustion chamber 37 (FIG. 1), that is, a reflux of exhaust gas occurs. During combustion of the air-fuel mixture during an expansion stroke in a later stage, the refluxed exhaust gas inhibits an excessive increase in combustion temperature of the air-fuel mixture, to reduce NOx concentration in the exhaust gas.

Figure 7:
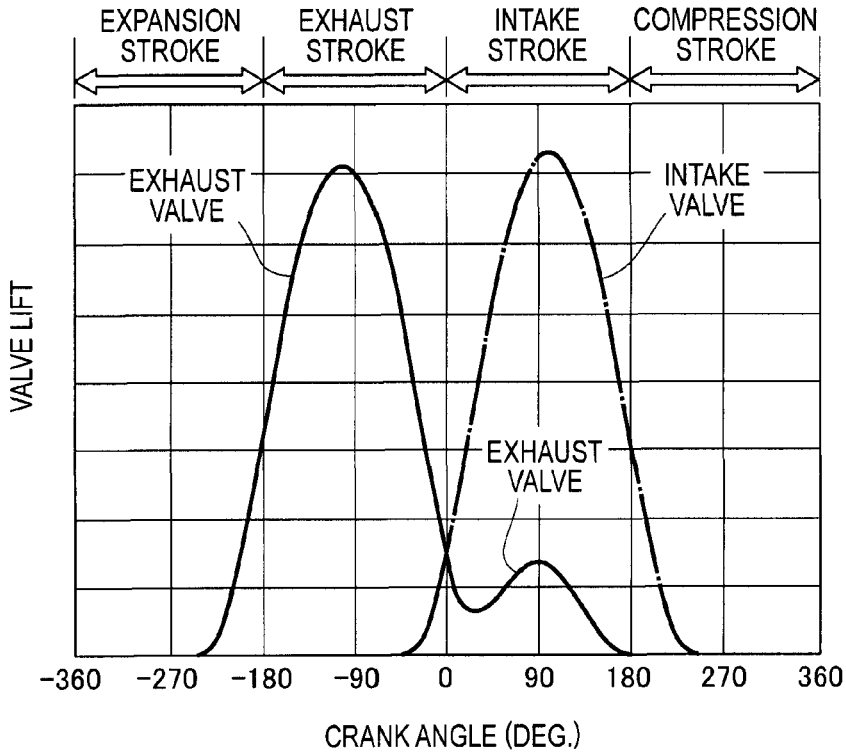
FIG. 7 is a graph showing the valve opening and closing timing of the intake and exhaust valves of the multipurpose engine according to a second embodiment of the present invention.

FIG. 7 is a graph similar to the graph of FIG. 6, but showing the valve opening and closing timing of the intake and exhaust valves 43 and 44 achieved by an exhaust gas reflux mechanism according to a second embodiment of the present invention. The valve opening and closing timing of the second embodiment shown in FIG. 7 differ from that of the first embodiment shown in FIG. 6 in that the exhaust valve 44 does not finishes closing before it is lifted up again by the action of the cam lobe 76*a* of the exhaust reflux cam 76 (FIG. 2B) during the intake stroke of the engine. More specifically, while the intake valve 43 stays open during the intake stroke, the exhaust valve is first about to finish closing a little after the start of the intake stroke, however, before being fully closed by the action of the cam 75, the exhaust valve 44 is lifted up again and stays open for a predetermined period of time, and finishes closing at the end of the intake stroke. Such motion of the exhaust valve 44 is achieved by properly profiling the cam lobe 76*a* of the exhaust reflux cam 76 in relation to the cam face (including the base circle 75*a* and the cam lobe 75*b*) of the single cam 75. In this instance, the lifts of the exhaust valve 44 and the intake valve 43 have peak values (maximum values) substantially at the same time. Furthermore, the lift of the exhaust valve 44 caused by the cam lobe 76*a* of the exhaust reflux cam 76 is much smaller than (about one-seventh of) the lift of the exhaust valve 44 caused by the cam lobe 75*b* of the cam 75. When the exhaust valve 44 stays open during the intake stroke, the exhaust gas remaining on the side of the exhaust port 42 (FIG. 1) is sucked or drawn into the combustion chamber 37 (FIG. 1), that is, a reflux of exhaust gas occurs. The exhaust gas reflux will achieve the same advantageous effect as described above with respect to the first embodiment. The lift of the exhaust valve 44 caused by the exhaust reflux cam lobe 76 is made slightly larger in the second embodiment shown in FIG. 7 than in the first embodiment shown in FIG. 6.

As thus far described, the exhaust gas reflux mechanism embodying the invention is configured for use in a multipurpose engine 10 of the type having an engine speed designed to automatically increase to a predetermined operating speed after a start-up of the engine and including an intake valve 43, an exhaust valve 44, and a single cam 75 provided on a camshaft 25 and driven to open and close the intake and exhaust valves in timed relation to each other. In order to allow part of an exhaust gas to be sucked or drawn into a combustion chamber 37 of the engine, the exhaust gas reflux mechanism includes an exhaust reflux cam 76 formed integrally with the single cam 75 as an integral part of the single cam 75 and having a cam lobe 76*a* profiled to open the exhaust valve while the intake valve stays open during an intake stoke of the engine. The thus constructed exhaust gas reflux mechanism is very simple in construction, does not require a separate component such as an actuator which is used in the conventional exhaust gas reflux apparatus as previously described, and is able to achieve downsizing and cost-reduction of the multipurpose engine 10.

With the arrangements so far described, the present invention can be used advantageously as an exhaust gas reflux mechanism for a multipurpose engine.

Obviously, various minor changes and modifications of the present invention are possible in light of the above teaching. It is therefore to be understood that within the scope of the appended claims the invention may be practiced otherwise than as specifically described.

What is claimed is:

1. An exhaust gas reflux mechanism of a multipurpose engine, comprising:

an intake valve which opens and closes to provide communication between an intake port and a combustion chamber, an exhaust valve which opens and closes to provide communication between an exhaust port and the combustion chamber, a single cam provided on a camshaft disposed above said combustion chamber, said single cam being driven to open and close the intake and exhaust valves in timed relation to each other, wherein an exhaust reflux cam is formed integrally with the single cam as an integral part of the single cam and has a cam lobe profiled to open the exhaust valve while the intake valve stays open during an intake stroke of the engine, so that a reflux of exhaust gas into a combustion chamber of the engine occurs during the intake stroke, and wherein an engine speed of said multipurpose engine automatically increases to a predetermined operating speed after a start-up of the engine.

2. The exhaust gas reflux mechanism of claim 1, wherein while the intake valve stays open during the intake stroke, the exhaust reflux cam opens the exhaust valve after the exhaust valve finishes closing by the action of the single cam.

3. The exhaust gas reflux mechanism of claim 1, wherein while the intake valve stays open during the intake stroke, the exhaust reflux cam lifts up the exhaust valve again before the exhaust valve finishes closing by the action of the single cam.

4. The exhaust gas reflux mechanism of claim 1, wherein the cam lobe of the exhaust reflux cam is profiled to finish closing of the exhaust valve at the end of the intake stroke.

5. The exhaust gas reflux mechanism of claim 1, wherein a valve lift provided by the exhaust reflux cam to the exhaust valve is approximately one-seventh of a valve lift provided by the single cam to the exhaust valve.

* * * * *